US010591855B2

(12) United States Patent
Maenishi

(10) Patent No.: US 10,591,855 B2
(45) Date of Patent: Mar. 17, 2020

(54) DUTY-RATIO CORRECTED CONTROL OF FIXING ROLLER POWER

(71) Applicant: Kyocera Document Solutions Inc., Osaka (JP)

(72) Inventor: Junta Maenishi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 16/219,904

(22) Filed: Dec. 13, 2018

(65) Prior Publication Data

US 2019/0187595 A1 Jun. 20, 2019

(30) Foreign Application Priority Data

Dec. 14, 2017 (JP) ..... 2017-239436

(51) Int. Cl.
*G03G 15/20* (2006.01)
*G03G 21/20* (2006.01)
*G03G 15/00* (2006.01)

(52) U.S. Cl.
CPC ..... *G03G 15/2042* (2013.01); *G03G 15/5029* (2013.01); *G03G 21/20* (2013.01)

(58) Field of Classification Search
CPC ..... G03G 15/2042; G03G 15/2046; G03G 15/5029; G03G 15/6588; G03G 21/20; G03G 21/203; G03G 2215/00734; G03G 15/2039
USPC ..... 399/44, 45, 69, 334; 219/216
See application file for complete search history.

(56) References Cited

U.S. PATENT DOCUMENTS 5,682,576 A * 10/1997 Sakai ..... G03G 15/2039 219/216
8,849,140 B2 * 9/2014 Saito ..... G03G 15/5004 399/67
2004/0131374 A1 * 7/2004 Sakai ..... G03G 15/2039 399/68
2009/0257770 A1 * 10/2009 Miyazaki ..... G03G 15/5004 399/69

(Continued)

FOREIGN PATENT DOCUMENTS

JP 63280283 A * 11/1988
JP 01011285 A * 1/1989

(Continued)

*Primary Examiner* — Robert B Beatty
(74) *Attorney, Agent, or Firm* — James Judge

(57) ABSTRACT

An image forming apparatus includes a width-information acquisition unit, an environmental-condition detecting unit, a heat roller, an end-portion-temperature-detecting unit, a first heater, a second heater, a first control unit, a first control unit, a correction-value derivation unit, an extracting unit, and a second control unit. The first heater heats a center portion of the heat roller. The second heater heats the end portion of the heat roller. The first control unit controls electric power supplied to the first heater with a first duty ratio. The correction-value derivation unit derives a correction value for the temperature condition based on an environmental condition. The extracting unit reflects the correction value for the temperature condition to extract a second duty ratio from among a plurality of second duty ratios. The second control unit controls the electric power supplied to the second heater with the data of the extracted second duty ratio.

5 Claims, 4 Drawing Sheets

(56) References Cited

U.S. PATENT DOCUMENTS

| | | | | |
|---|---|---|---|---|
| 2013/0188977 | A1* | 7/2013 | Hase | G03G 15/2042 399/69 |
| 2017/0168433 | A1* | 6/2017 | Okamoto | G03G 15/2042 |

FOREIGN PATENT DOCUMENTS

| | | | | |
|---|---|---|---|---|
| JP | 2001312178 | A | * | 11/2001 |
| JP | 2015-197670 | A | | 11/2015 |
| JP | 2017-111253 | A | | 6/2017 |

* cited by examiner

FIG. 5

51

| | | | |
|---|---|---|---|
| 15 | ≦ End-Portion Temperature − Target Temperature | | 52a |
| 10 | ≦ End-Portion Temperature − Target Temperature < | 15 | 52b |
| 5 | ≦ End-Portion Temperature − Target Temperature < | 10 | 52c |
| −15 | ≦ End-Portion Temperature − Target Temperature < | 5 | 52d |
| −23 | ≦ End-Portion Temperature − Target Temperature < | −15 | 52e |
| −25 | ≦ End-Portion Temperature − Target Temperature < | −23 | 52f |
| | End-Portion Temperature − Target Temperature < | −25 | 52g |

53 54

FIG. 6

56

| | | | |
|---|---|---|---|
| 40 | ≦ End-Portion Temperature − Target Temperature | | 57a |
| 35 | ≦ End-Portion Temperature − Target Temperature < | 40 | 57b |
| 30 | ≦ End-Portion Temperature − Target Temperature < | 35 | 57c |
| 10 | ≦ End-Portion Temperature − Target Temperature < | 30 | 57d |
| 2 | ≦ End-Portion Temperature − Target Temperature < | 10 | 57e |
| 0 | ≦ End-Portion Temperature − Target Temperature < | 2 | 57f |
| | End-Portion Temperature − Target Temperature < | 0 | 57g |

58 59

DUTY-RATIO CORRECTED CONTROL OF FIXING ROLLER POWER

INCORPORATION BY REFERENCE

This application is based upon, wherein the benefit of priority is claimed from, corresponding Japanese Patent Application No. 2017-239436 filed in the Japanese Patent Office on Dec. 14, 2017, and the entire contents of which are incorporated herein by reference.

BACKGROUND

Unless otherwise indicated herein, the description in this section is not prior art to the claims in this application and is not admitted to be prior art by inclusion in this section.

An image forming apparatus typified by a multi-functional peripheral reads an image of a document using an image reading unit, subsequently irradiates a photoreceptor, which is included in an image forming unit, with light based on the read image to form an electrostatic latent image on the photoreceptor. Then, the image forming apparatus supplies charged toners on the formed electrostatic latent image to form a visible image, and subsequently transfers the toner to be fixed on a paper sheet, and outputs it outside the apparatus.

Here, there are proposed techniques on a fixing unit that is included in an image forming apparatus and fixes toner on a paper sheet.

One of the above-described fixing unit includes: a roller that fixes an image on a paper sheet; a plurality of heaters that are located inside the roller and configured such that a distribution of an amount of supplied heat differs in a longitudinal direction of the roller; a temperature detecting unit that detects temperatures of the roller; and a control unit that performs an energization control of the heater by a pattern of a half-wave period of an AC power supply based on a detection result detected by the temperature detecting unit. The control unit has a feature that when the temperature detecting unit detects that a temperature of an end portion of the roller in the longitudinal direction is lower than a set target temperature, the control unit performs a full energization control to the heater having the largest amount of supplied heat at its end portion among the plurality of heaters and also performs the energization control on the heater having the next largest amount of supplied heat at its end portion among the plurality of heaters by a pattern of a predetermined duty ratio, or performs the energization control on the heater having the largest amount of supplied heat at its end portion among the plurality of heaters by the pattern of the predetermined duty ratio and also performs the energization control by turning off the heater having the next largest amount of supplied heat at its end portion among the plurality of heaters.

Another of the above-described image forming apparatus includes: a fixing roller that heats and fixes a toner image on a paper sheet; a first heater that is located to heat the fixing roller and has a heat generation amount at one end portion of the fixing roller in an axial direction larger than that of the other end portion; a second heater that has a heat generation amount at the other end portion larger than that of the one end portion; a temperature sensor that detects the temperatures of the fixing roller; and a control unit that determines an energization ratio of the first heater and the second heater such that the temperature detected by the temperature sensor becomes equal to a target temperature to control energization and non-energization of the first heater and the second heater by the energization ratio, and also obtains a temperature gradient value of the fixing roller in the axial direction generated by the energization of the first heater and/or the energization of the second heater and non-energization of both the first heater and the second heater, and then causes the heater that decreases the temperature gradient value to be preferentially energized.

SUMMARY

An image forming apparatus according to one aspect of the disclosure forms an image on a paper sheet. The image forming apparatus includes a developing unit, a width-information acquisition unit, an environmental-condition detecting unit, a heat roller, an end-portion-temperature-detecting unit, a first heater, a second heater, a first control unit, a storage unit, a correction-value derivation unit, an extracting unit, and a second control unit. The developing unit forms a toner image on a paper sheet. The width-information acquisition unit acquires information of a width of the paper sheet. The environmental-condition detecting unit that detects environmental conditions at a time of image formation on the paper sheet. The heat roller has a cylindrical shape. The heat roller contacts the paper sheet on which the toner image is formed by the developing unit, so as to fix the toner image on the paper sheet. The end-portion-temperature-detecting unit detects a temperature of an end portion of the heat roller in a longitudinal direction. The first heater is located inside the heat roller. The first heater heats a center portion of the heat roller in the longitudinal direction. The second heater is located inside the heat roller. The second heater heats the end portion of the heat roller in the longitudinal direction. The first control unit controls electric power supplied to the first heater with a first duty ratio. The first duty ratio is a duty ratio of the electric power supplied to the first heater. The storage unit stores a plurality of paper-sheet-width conditions based on the width of the paper sheet detected by the width-information acquisition unit, a plurality of temperature conditions corresponding to a difference between the temperature of the end portion detected by the end-portion-temperature-detecting unit and a predetermined target temperature, and a plurality of items of data of second duty ratios that are derived based on the first duty ratio. The second duty ratio is a duty ratio of electric power supplied to the second heater. The correction-value derivation unit derives a correction value for the temperature condition based on the environmental conditions detected by the environmental-condition detecting unit. The extracting unit reflects the correction value for the temperature condition derived by the correction-value derivation unit to extract the data of the second duty ratio from among the plurality of items of data of the second duty ratios stored in the storage unit. The second control unit controls the electric power supplied to the second heater with the data of the second duty ratio extracted by the extracting unit.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

BRIEF DESCRIPTION OF THE DRAWINGS

FIG. 5 illustrates a part of a pre-correction table.

FIG. 6 illustrates a part of a post-correction table obtained by adding a correction value to each value of temperature conditions.

DETAILED DESCRIPTION

Figure 1:
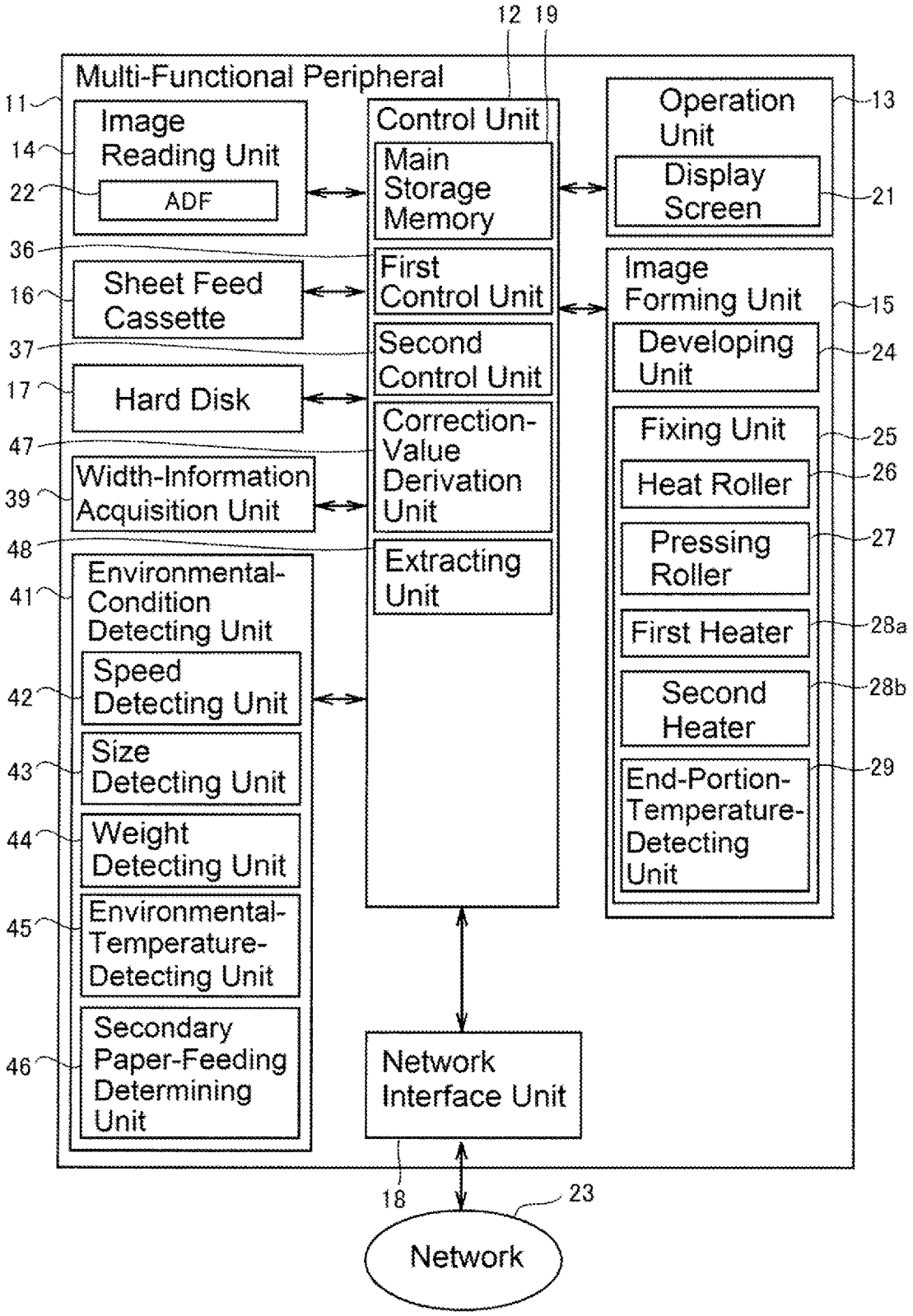
FIG. 1 illustrates a block diagram illustrating a configuration of a multi-functional peripheral when an image forming apparatus according to one embodiment of the disclosure is applied to the multi-functional peripheral.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes an embodiment of the disclosure. In the following drawings, like reference numerals designate the similar or corresponding configuration, and their descriptions will not be further elaborated here.

FIG. 1 illustrates a block diagram illustrating a configuration of a multi-functional peripheral when an image forming apparatus according to one embodiment of the disclosure is applied to the multi-functional peripheral. With reference to FIG. 1, a multi-functional peripheral 11 has a plurality of functions such as a copy function, a printer function, and a facsimile function regarding image processing.

The multi-functional peripheral 11 includes a control unit 12, an operation unit 13, an image reading unit 14, an image forming unit 15, a sheet feed cassette 16, a hard disk 17 as a storage unit, and a network interface unit 18 to connect to a network 23. The control unit 12 includes a main storage memory 19 that temporarily stores data, and includes a processor, a random-access memory (RAM), a read-only memory (ROM), and similar electronic component. The main storage memory 19 functions as a storage unit. The processor is a central processing unit (CPU), an ASIC, an MCU, and similar electronic component. The control unit 12, by the above-described processor executing control programs stored in the above-described ROM or main storage memory 19, functions as a first control unit 36 and similar unit, which will be described later, and controls the whole multi-functional peripheral 11. The above-described respective components of the control unit 12 each may include hardware circuits, not by the operations based on the above-described control programs.

The operation unit 13 accepts an input regarding image formation that is image formation conditions such as the number of copies of the image formation, namely, the number of print copies, a size of a paper sheet, a type of paper sheet, a conveyance speed of the paper sheet, a start instruction of the image formation, and a tone from a user. The operation unit 13 includes a display screen 21 as a display that displays the information transmitted from the multi-functional peripheral 11 side and input contents of the user. The image reading unit 14 includes an automatic document feeder (ADF) 22 as a document feeder that conveys the document set at a set position to a reading position. The image reading unit 14 reads an image of the document set on the ADF 22 or a placement table on which the document is placed. The sheet feed cassette 16 can internally house a plurality of paper sheets. The image forming unit 15 includes a developing unit 24 that forms a toner image on the conveyed paper sheet and a fixing unit 25 that fixes the toner image on the paper sheet on which the toner image is formed by the developing unit 24. The image forming unit 15, based on image data of the document read by the image reading unit 14 and the image data transmitted via the network 23, forms and prints the image on the paper sheet conveyed from the sheet feed cassette 16. The hard disk 17 stores data on the image formation, such as the image data received via the network 23 and the input image formation conditions.

Figure 2:
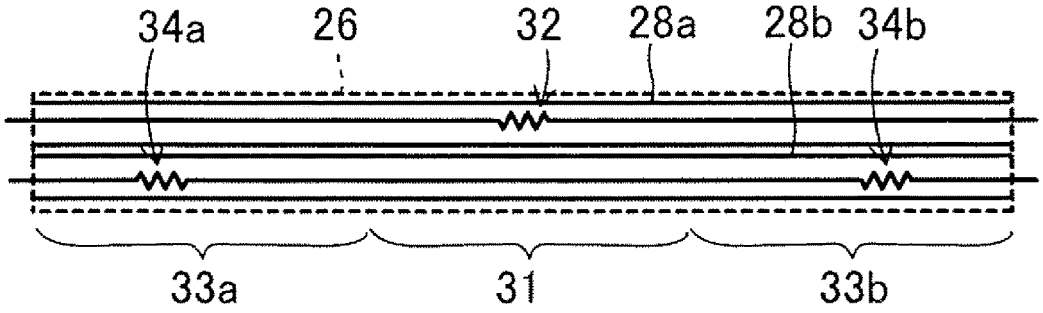
FIG. 2 schematically illustrates a part of a configuration of a fixing unit according to the one embodiment.

Next, the configuration of the fixing unit 25 will be briefly described. FIG. 2 schematically illustrates a part of the configuration of the fixing unit 25. In terms of ease of understanding, FIG. 2 illustrates an outer shape of a heat roller 26 with a dashed line. In addition, with reference to FIG. 2, the fixing unit 25 includes the heat roller 26, a pressing roller 27, a first heater 28*a*, a second heater 28*b*, and an end-portion-temperature-detecting unit 29. The heat roller 26 has a hollow cylindrical shape and is rotatably located. The pressing roller 27 has a solid columnar shape and is rotatably located. The heat roller 26 and the pressing roller 27 are each located to be in contact with one another, and the paper sheet with an unfixed toner image is conveyed between the heat roller 26 and the pressing roller 27. Then, heating and pressurization by the rotating heat roller 26 and pressing roller 27 cause the toner image to be fixed on the paper sheet.

The heat roller 26 internally includes the first heater 28*a* and the second heater 28*b*. The first heater 28*a* has, what is called, a bar shape, and a heating unit 32 including a resistor or similar component is located at a center portion 31 in a longitudinal direction. The first heater 28*a* is located such that the center portion 31 of the heat roller 26 in the longitudinal direction is heated from an inside of the heat roller 26 by the heating unit 32. The second heater 28*b* also has, what is called, a bar shape, and when located inside the heat roller 26, heating units 34*a* and 34*b* including a resistor or similar component are located at end portions of the heat roller 26 in the longitudinal direction, specifically, at both end portions 33*a* and 33*b*. The second heater 28*b* is located such that both the end portions 33*a* and 33*b* of the heat roller 26 in the longitudinal direction are heated from the inside of the heat roller 26 by the heating units 34*a* and 34*b*. The second heater 28*b* heats both the end portions 33*a* and 33*b* of the heat roller 26 in the longitudinal direction, and the end-portion-temperature-detecting unit 29 detects the temperature of the end portion of the heat roller 26 in the longitudinal direction, in this case, the end portion 33*a* at one side in the longitudinal direction. As the end-portion-temperature-detecting unit 29, for example, a thermistor or similar component is employed.

The control unit 12 included in the multi-functional peripheral 11 includes the first control unit 36 and a second control unit 37. The first control unit 36 controls the electric power supplied to the first heater 28*a* with a first duty ratio as a duty ratio of the electric power supplied to the first heater 28*a*. The second control unit 37 controls the electric power supplied to the second heater 28*b* with data of a second duty ratio extracted by an extracting unit 48, which will be described later.

Figure 3:
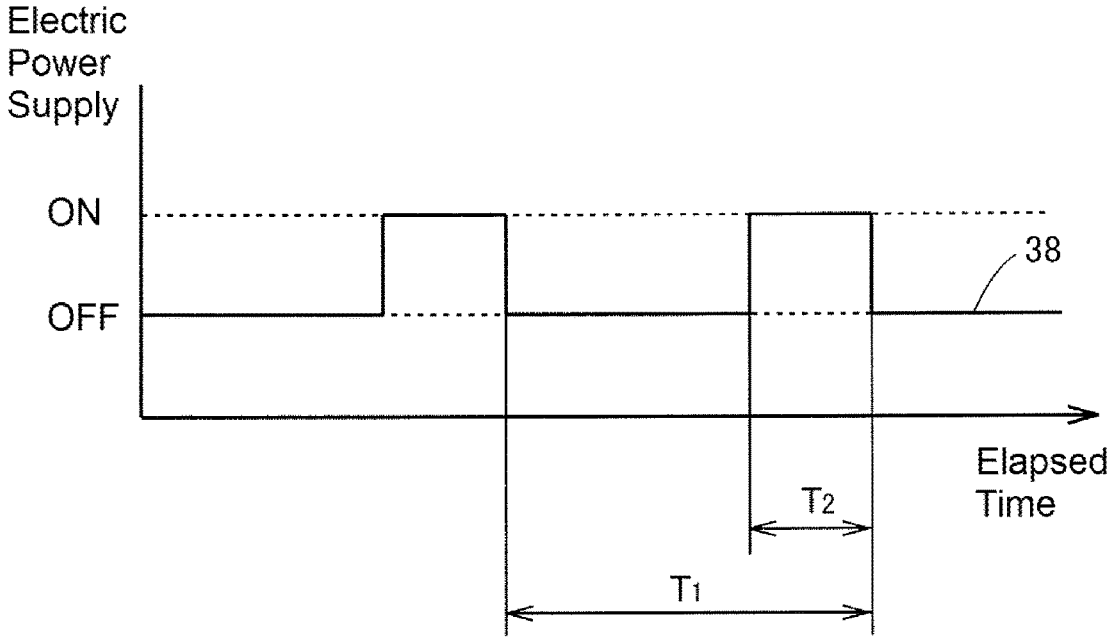
FIG. 3 illustrates a voltage that is supplied to a first heater according to the one embodiment.

Here, the duty ratio will be briefly described as follows. FIG. 3 illustrates a voltage supplied to the first heater 28*a*. With reference to FIG. 3, the voltage supplied to the first heater 28*a*, which is represented by a signal indicated with a line 38, repeats on-states and off-state alternately. Here, of a combination of one on-state and one off-state, the duty ratio denotes a proportion of a time period required for the on-state relative to a whole. That is, in the case illustrated in FIG. 3, assuming that a total time period of one set of the on-state and the off-state is a time period $T_1$, and a time period of the on-state is a time period $T_2$, the duty ratio is expressed by a percentage calculated by $T_2/T_1 \times 100$. For example, the duty ratio of 35(%) denotes that the proportion of the time period $T_2$ to the time period $T_1$ is 35%. Increasing the duty ratio means supplying more electric power.

The multi-functional peripheral 11 includes a width-information acquisition unit 39 that acquires information of a width of a paper sheet. The width-information acquisition unit 39 acquires the information of the width of the paper sheet used in forming an image. The width-information acquisition unit 39 acquire the information of the width of the paper sheet, based on, for example, the size or similar information of the paper sheet input via the operation unit 13.

The hard disk 17 stores: paper sheet width conditions based on the information of the width of the paper sheet detected by the width-information acquisition unit 39; temperature conditions corresponding to a difference between the temperature of the end portion detected by the end-portion-temperature-detecting unit 29 and a predetermined target temperature; and the data of the second duty ratio that is derived based on the first duty ratio and is the duty ratio of the electric power supplied to the second heater 28*b*. Specifically, when the paper sheet width is 200 mm, the difference is 0, and the first duty ratio is 50, because the paper sheet width condition is equal to or more than 185 mm and less than 215 mm in the paper sheet width, and the temperature condition is equal to or more than −5 and less than 5, the data that the second duty ratio corresponding to the first duty ratio of 50 is 35 is stored. These items of data are stored in a table format by the respective paper-sheet-width conditions and the respective temperature conditions. Specifically, the first duty ratio is divided in increments of 5. The data of the target temperature of the end portion that is used to calculate the temperature conditions is also stored in the hard disk 17.

The multi-functional peripheral 11 includes an environmental-condition detecting unit 41 that detects environmental conditions at a time of the image formation on the paper sheet. The environmental-condition detecting unit 41 further includes a plurality of detecting units or similar units. Specifically, the environmental-condition detecting unit 41 includes a speed detecting unit 42, a size detecting unit 43, a weight detecting unit 44, an environmental-temperature-detecting unit 45, and a secondary paper-feeding determining unit 46. The speed detecting unit 42 detects the conveyance speed of the paper sheet at the time of the image formation, for example, being a full speed or a half speed. The size detecting unit 43 detects the size of the paper sheet, specifically, for example, the size of the paper sheet such as A3 size or A4 size. The weight detecting unit 44 detects the weight of the paper sheet, for example, a basis weight or similar weight. The environmental-temperature-detecting unit 45 detects the environmental conditions where the multi-functional peripheral 11 is installed, specifically, for example, the temperatures of the place where the multi-functional peripheral 11 is installed. The secondary paper-feeding determining unit 46 determines whether a paper sheet to be fed is after a secondary paper-feeding start transition or not. The secondary paper-feeding start transition means a state from an issuance of an instruction of a print start to the start of the secondary paper feeding, namely, a state until a fixing unit reaches a specified temperature state.

The hard disk 17 stores data of correction values for the temperature conditions based on the environmental conditions detected by the environmental-condition detecting unit 41. Specifically, the correction values for the corresponding temperature conditions are stored based on the following detected at the time of the image formation: the conveyance speed of the paper sheet; the size of the paper sheet; the weight of the paper sheet; the temperature of the place where the multi-functional peripheral 11 is installed; and whether it is secondary paper feeding or not. For example, if the environmental conditions are "Full Speed," "Weight-Level 5" in descending order of weight classified into eight stages, "Size 3" being a middle size among sizes classified into five stages, "Normal Temperature" as the temperature of the location where the multi-functional peripheral 11 is installed, and "After Transition To Secondary Paper-Feeding Start," the correction value for the temperature conditions might be "25." These items of data are stored in the table format by the weight level and the size level.

The control unit 12 included in the multi-functional peripheral 11 includes a correction-value derivation unit 47 and the extracting unit 48. The correction-value derivation unit 47 derives the correction value for the temperature conditions based on the environmental conditions detected by the environmental-condition detecting unit 41. The extracting unit 48 reflects the correction value for the temperature conditions derived by the correction-value derivation unit 47 to extract data of the second duty ratio from among the data of the second duty ratios stored in the hard disk 17. These configurations will be described later.

Figure 4:
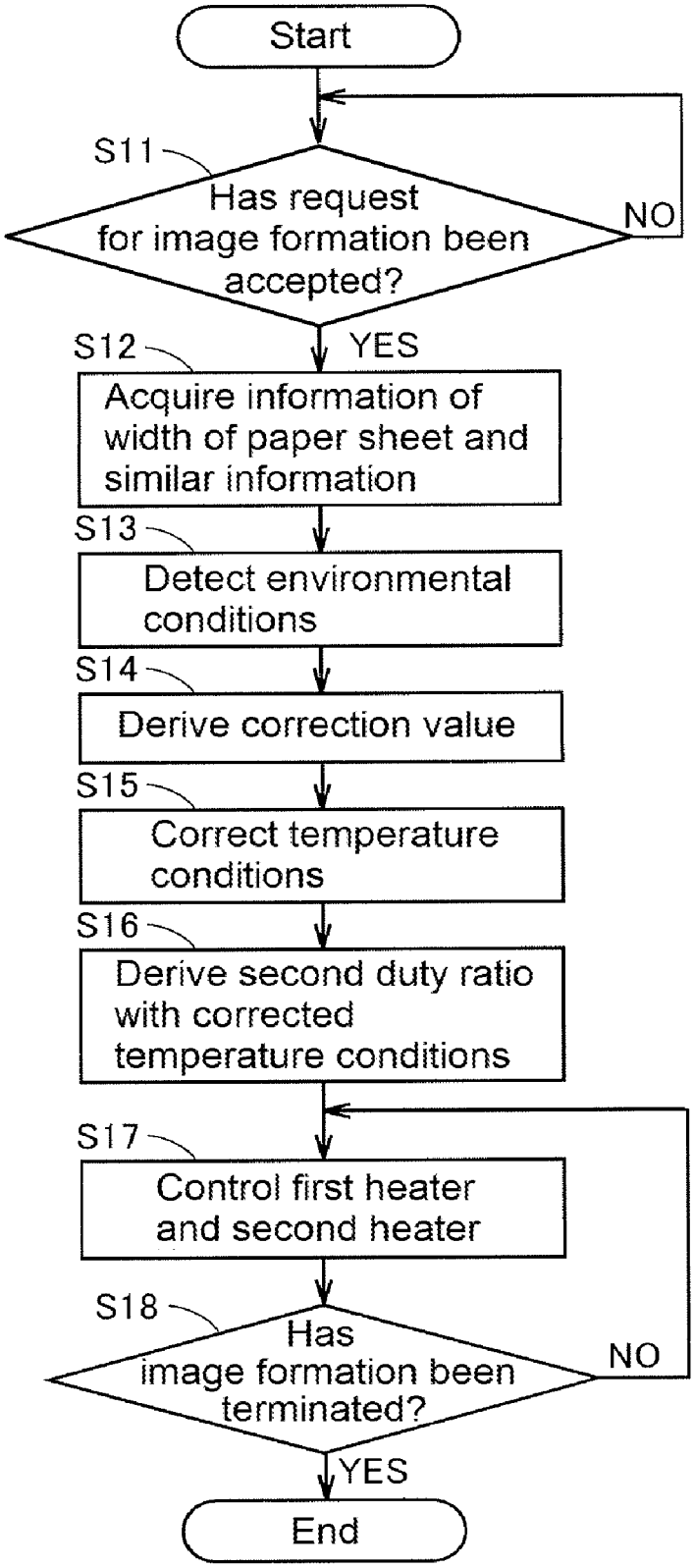
FIG. 4 illustrates a flow of processes when an image is formed on a paper sheet, in the multi-functional peripheral according to the one embodiment.

Next, in the multi-functional peripheral 11, a flow of processes in forming an image on a paper sheet will be described. In the multi-functional peripheral 11 illustrated in FIG. 1, FIG. 4 illustrates the flow of the processes in forming an image on a paper sheet.

In addition, with reference to FIG. 4, the multi-functional peripheral 11 accepts a request for the image formation, such as a request for a copy (in FIG. 4, YES at Step S11, hereinafter, "Step" will be omitted). In this case, it is assumed that a request for image formation on a plurality of paper sheets is accepted.

Then, the width-information acquisition unit 39 acquires information such as the information of the width of the paper sheet (S12). In this case, the width-information acquisition unit 39 may acquire the information of the width of the paper sheet from data of specified sizes of the paper sheets input via the operation unit 13. In addition, the temperature of the end portion 33*a* of the heat roller 26 is obtained by the end-portion-temperature-detecting unit 29. The temperature of the end portion 33*a* of the heat roller 26 detected by the end-portion-temperature-detecting unit 29 is used in calculating the difference from the predetermined target temperature. Furthermore, the information of the first duty ratio is also obtained. These items of information are stored in, for example, the main storage memory 19 or similar memory.

Subsequently, the environmental conditions are detected by the environmental-condition detecting unit 41 (S13).

Specifically, the speed detecting unit 42 detects that the conveyance speed of the paper sheet, for example, a linear velocity of the paper sheet is a full speed or a half speed. In this case, the conveyance speed of the paper sheet may be detected by the input with the operation unit 13. The size detecting unit 43 detects the size of the paper sheet. The weight detecting unit 44 detects the weight of the paper sheet. These environmental conditions may also be detected from, for example, the size of the paper sheet, the type of the paper sheet, and similar item of the paper sheet specified by the input via the operation unit 13. The environmental-temperature-detecting unit 45 detects the temperature of the place where the multi-functional peripheral 11 is installed. Furthermore, the secondary paper-feeding determining unit 46 determines whether the paper sheet to be fed is after the secondary paper-feeding start transition or not.

Then, from these detected environmental conditions, the correction-value derivation unit 47 derives the correction value for the temperature conditions (S14). That is, the correction-value derivation unit 47 derives the correction value for the temperature conditions based on: the speed of the paper sheet detected by the speed detecting unit 42; the size of the paper sheet detected by the size detecting unit 43; the weight of the paper sheet detected by the weight detecting unit 44; the temperature of the place, where the multi-functional peripheral 11 is installed, detected by the environmental-temperature-detecting unit 45; and the determination of whether the fed paper sheet is after the secondary paper-feeding start transition or not, which is determined by the secondary paper-feeding determining unit 46. In this case, the correction value for the temperature conditions is derived based on the information in the table stored in the hard disk 17. For example, it is assumed that the correction value is 25.

Then, the temperature conditions are corrected by the derived correction value (S15). That is, the correction value of 25 is added to each value of the temperature conditions.

FIG. 5 illustrates a part of a pre-correction table. FIG. 6 illustrates a part of a post-correction table where the correction value is added to each of the temperature conditions. First, with reference to FIG. 5, a pre-correction table 51 specifies, for example, seven temperature conditions 52*a*, 52*b*, 52*c*, 52*d*, 52*e*, 52*f*, and 52*g* with respect to one paper-sheet-width condition. Then, in the pre-correction table 51, lower-limit values 53 surrounded by an alternate long and short dash line among the respective temperature conditions 52*a* to 52*f* are 15, 10, 5, −15, −23, and −25 in descending order. Upper-limit values 54 surrounded by a two-dot chain line among the temperature conditions 52*b* to 52*g* are 15, 10, 5, −15, −23, and −25 in descending order. The correction value "25" is added with respect to these lower-limit values 53 and upper-limit values 54. That is, the lower-limit values 53 and the upper-limit values 54 are shifted.

With reference to FIG. 6, a post-correction table 56 specifies seven temperature conditions 57*a*, 57*b*, 57*c*, 57*d*, 57*e*, 57*f*, and 57*g*, where the correction value is reflected, with respect to one paper-sheet-width condition. Lower-limit values 58 surrounded by an alternate long and short dash line among the temperature conditions 57*a* to 57*f* are 40, 35, 30, 10, 2, and 0 in descending order. Upper-limit values 59 surrounded by the two-dot chain line among the temperature conditions 57*b* to 57*g* are 40, 35, 30, 10, 2, and 0 in descending order.

The extracting unit 48 reflects the correction value for the temperature conditions derived by the correction-value derivation unit 47 to extract the data of the second duty ratio from among the data of the second duty ratios stored in the hard disk 17 (S16).

Then, the second control unit 37 controls the electric power to be supplied to the second heater 28*b* with the data of the second duty ratio extracted by the extracting unit 48 (S17). That is, both the end portions 33*a* and 33*b* of the heat roller 26 are heated based on the on-state or the off-state of the second heater 28*b* based on the second duty ratio. This is performed until the image formation is terminated (S18).

According to such multi-functional peripheral 11, controlling the temperature of the heat roller 26 in consideration of the environmental conditions ensures more appropriate fixing of the toner image on the paper sheet. That is, this ensures more appropriate control of the temperature of the heat roller 26, even when the temperature is high or low, to fix the toner image on the paper sheet. Consequently, such multi-functional peripheral 11 ensures more appropriate image formation on the paper sheet.

That is, this ensures preventing the following problem. Specifically, for example, when the speed of the paper sheet is set as the half speed against the full speed, setting the correction value as "35%" in the case of the full speed causes the temperature of both the end portions 33*a* and 33*b* to excessively increase. Conversely, assuming that the paper sheet is a cardboard like an envelope, equally defining the duty ratio to be increased by 10% in the case of the cardboard controls the temperature to be further increased even when the temperatures at both the end portions 33*a* and 33*b* are high for the currently measured temperature, and thus causing an inappropriate duty ratio. However, the above-described multi-functional peripheral 11 ensures preventing such problem.

In this case, because the environmental-condition detecting unit 41, at a time of the image formation, detects the following information as the environmental conditions: the conveyance speed of the paper sheet; the size of the paper sheet; the weight of the paper sheet; the temperature of the place where the multi-functional peripheral 11 is installed; and whether the paper sheet is after the secondary paper-feeding start transition or not, and thus it ensures more strict control of the second duty ratio in accordance with the environmental conditions.

In this case, the hard disk 17 stores a plurality of correction values for the temperature conditions corresponding to the predetermined temperature conditions. The correction-value derivation unit 47 derives from among the plurality of correction values for the temperature conditions stored in the hard disk 17, and thus, this eliminates the complicated calculation in deriving the correction value for the temperature conditions and ensures the reduced processing load.

While in the above-described embodiment, the environmental-condition detecting unit 41, at the time of the image formation, detects the following information as the environmental conditions: the conveyance speed of the paper sheet; the size of the paper sheet; the weight of the paper sheet; the temperature of the place where the multi-functional peripheral 11 is installed; and whether the paper sheet is after the secondary paper-feeding start transition or not, it is not limited to this. The environmental-condition detecting unit 41, at the time of the image formation, may detect at least any one of the following information as the environmental conditions: the conveyance speed of the paper sheet; the size of the paper sheet; the weight of the paper sheet; the temperature of the place where the multi-functional peripheral 11 is installed; and whether the paper sheet is after the secondary paper-feeding start transition or not. This also ensures controlling the second duty ratio in accordance with the environmental conditions.

The image forming apparatus according to the disclosure is especially effectively used when more reliable image formation on a paper sheet is required.

Exemplary Embodiment of the Disclosure

The image forming apparatus according to the disclosure is an image forming apparatus that forms an image on a paper sheet. The image forming apparatus includes a developing unit, a width-information acquisition unit, an environmental-condition detecting unit, a heat roller, an end-portion-temperature-detecting unit, a first heater, a second heater, a first control unit, a storage unit, a correction-value derivation unit, an extracting unit, and a second control unit. The developing unit forms a toner image on a paper sheet. The width-information acquisition unit acquires information of a width of the paper sheet. The environmental-condition detecting unit detects environmental conditions at a time of image formation on the paper sheet. The heat roller has a cylindrical shape. The heat roller contacts the paper sheet on which the toner image is formed by the developing unit to fix the toner image on the paper sheet. The end-portion-temperature-detecting unit detects a temperature of an end portion of the heat roller in a longitudinal direction. The first heater is located inside the heat roller. The first heater heats a center portion of the heat roller in the longitudinal direction. The second heater is located inside the heat roller. The second heater heats the end portion of the heat roller in the longitudinal direction. The first control unit controls an electric power supplied to the first heater with a first duty ratio. The first duty ratio is a duty ratio of the electric power supplied to the first heater. The storage unit stores a plurality of: a paper-sheet-width condition based on the width of the paper sheet detected by the width-information acquisition unit; a temperature condition corresponding to a difference between the temperature of the end portion detected by the end-portion-temperature-detecting unit and a predetermined target temperature; and data of second duty ratios that are derived based on the first duty ratio. The second duty ratio is a duty ratio of an electric power supplied to the second heater. The correction-value derivation unit derives a correction value for the temperature conditions based on the environmental conditions detected by the environmental-condition detecting unit. The extracting unit reflects the correction value for the temperature condition derived by the correction-value derivation unit to extract the data of the second duty ratio from among the data of the second duty ratios stored in the storage unit. The second control unit controls the electric power supplied to the second heater with the data of the second duty ratio extracted by the extracting unit.

Effect of the Disclosure

Such image forming apparatus ensures more appropriate image formation on a paper sheet.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus that forms an image on a paper sheet, comprising:

a developing unit in which a toner-developed image is formed onto a paper sheet;

a width-information acquisition unit that acquires information of a width of the paper sheet;

an environmental-condition detecting unit that detects environmental conditions at a time of image formation on the paper sheet;

a heat roller that has a cylindrical shape, the heat roller contacting the paper sheet on which the toner image is formed by the developing unit, so as to fix the toner image on the paper sheet;

an end-portion-temperature-detecting unit that detects a temperature of an end portion of the heat roller in the heat roller's longitudinal direction;

a first heater located inside the heat roller, the first heater heating a center portion of the heat roller in its longitudinal direction;

a second heater located inside the heat roller, the second heater heating the end portion of the heat roller in its longitudinal direction;

a first control unit that controls electric power supplied to the first heater according to a first duty ratio, the first duty ratio being a duty ratio of the electric power supplied to the first heater;

a storage unit that plurally stores paper-sheet-width conditions based on the width of the paper sheet detected by the width-information acquisition unit, stores temperature conditions corresponding to a difference between the temperature of the end portion detected by the end-portion-temperature-detecting unit and a predetermined target temperature, and stores second-duty-ratio data for second duty ratios, being duty ratios of electric power supplied to the second heater, derived based on the first duty ratio;

a correction-value derivation unit that based on the environmental conditions detected by the environmental-condition detecting unit derives a temperature-conditions correction value;

an extracting unit that, from among second-duty-ratio data, stored in the storage unit, in which the extracting unit reflects the temperature-conditions correction value derived by the correction-value derivation unit, extracts post-correction second-duty-ratio data; and a second control unit that controls the electric power supplied to the second heater according to the post-correction second-duty-ratio data extracted by the extracting unit.

2. The image forming apparatus according to claim 1, wherein the environmental-condition detecting unit detects at least any one of the following information at a time of image formation as the environmental conditions: a conveyance speed of the paper sheet; a size of the paper sheet; a weight of the paper sheet; a temperature of a place where the image forming apparatus is installed; and whether the paper sheet is after a secondary paper-feeding start transition or not.

3. The image forming apparatus according to claim 1, wherein:

the storage unit stores a plurality of correction values for the temperature conditions corresponding to the predetermined environmental conditions; and the correction-value derivation unit derives from among the plurality of correction values for the temperature conditions stored in the storage unit.

4. The image forming apparatus according to claim 1, wherein the storage unit stores the data of the second duty ratios in a table format.

5. The image forming apparatus according to claim 1, wherein the second heater heats both the end portions of the heat roller in the longitudinal direction, the authentication device according to claim 1; and a functional unit that restricts a predetermined function and releases a use restriction of the predetermined function in response to the authentication by the authentication device.

* * * * *